United States Patent [19]

Pentikäinen et al.

[11] Patent Number: 4,558,731

[45] Date of Patent: Dec. 17, 1985

[54] CONTROL DEVICE FOR MEDIUM FLOWS FOR REGENERATIVE HEAT EXCHANGER

[75] Inventors: Ismo Pentikäinen, Järvenpää; Seppo Pentikäinen, Espoo; Timo Pentikäinen, Joutseno, all of Finland

[73] Assignee: Orpocon Oy, Espoo, Finland

[21] Appl. No.: 625,861

[22] PCT Filed: Oct. 17, 1983

[86] PCT No.: PCT/FI83/00064

§ 371 Date: Jun. 18, 1984

§ 102(e) Date: Jun. 18, 1984

[87] PCT Pub. No.: WO84/01617

PCT Pub. Date: Apr. 26, 1984

[30] Foreign Application Priority Data

Oct. 18, 1982 [FI] Finland ..... 823541
Aug. 16, 1983 [FI] Finland ..... 832942

[51] Int. Cl.[4] ..... F28D 17/00

[52] U.S. Cl. ..... 165/4; 165/10; 137/309

[58] Field of Search ..... 165/4, 10; 55/179, 180; 137/309

[56] References Cited

U.S. PATENT DOCUMENTS 1,739,507 12/1929 De Lorenzi ..... 165/4
1,759,916 5/1930 Riley ..... 165/4
1,811,455 6/1931 Cook ..... 165/4

FOREIGN PATENT DOCUMENTS 65588 4/1982 Japan ..... 165/4
2059040 4/1981 United Kingdom ..... 165/4

*Primary Examiner*—Albert W. Davis, Jr.
*Attorney, Agent, or Firm*—Seidel, Gonda, Goldhammer & Abbott

[57] ABSTRACT

The present invention is concerned with a control device for medium flows for a regenerative heat exchanger. The device consists of a cell (7) divided into compartments (8) and acting as a heat exchanger, and at the ends of the cell, there are control means (11, 12) for guiding the medium flows alternatingly into the different compartments (8) of the cell (7). In prior art, unreasonably high capacities of actuating devices have been required for controlling the flows of media, and the control devices have increased the length of the heat exchanger considerably. These drawbacks are avoided if the control means consist of a slide (11, 12) displaceable transversely in relation to the partition walls (9) of the cell, the said slide (11, 12) being provided with openings (13) and with blocking members (14) between the openings for the purpose of alternatingly opening and closing connections between medium flow ducts (2, 3, 5, 6) and compartments (8) in the cell.

3 Claims, 9 Drawing Figures

CONTROL DEVICE FOR MEDIUM FLOWS FOR REGENERATIVE HEAT EXCHANGER

Figure 1:
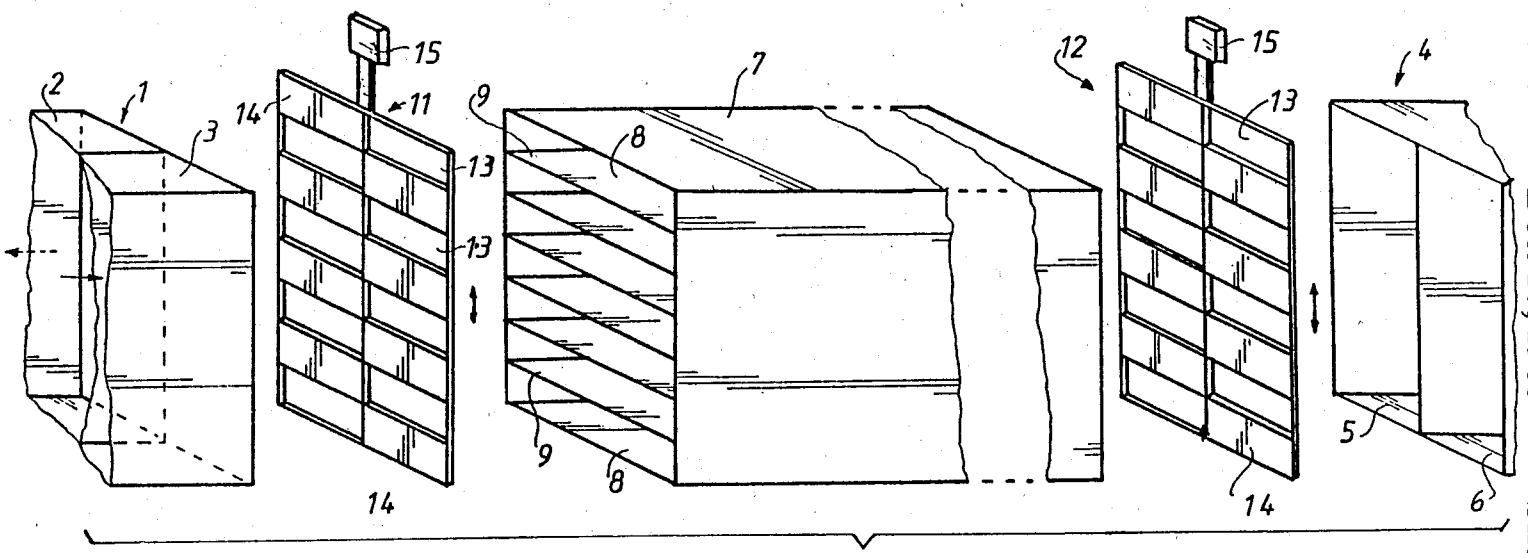

The present invention is concerned with a control device for medium flows for a regenerative heat exchanger, in which the control device is placed between ductings which are divided into medium flow ducts by means of at least one partition wall.

There are two main types of heat exchangers, recuperative and regenerative. In the former type, the heat is transferred from one medium flow to the other through the walls in the heat exchanger. In the latter one, on the other hand, a heat accumulating material in the cell of the heat exchanger is charged with the heat energy of the warm flow, and thereupon the charge is discharged by passing a cold flow into contact with the charged material. It results from the principle of operation of the regenerator that either the heat faces must be mobile, e.g. rotating designs, or the medium flows must be controlled periodically along different routes.

A rotating, regenerative heat exchanger is known, e.g., from the German Pat. No. 881,046, wherein a cell wheel placed in a casing is provided with through openings that contain radial wires that accumulate heat. The casing and the wheel are provided with control wings which guide the cold and warm air flows via the charging wires depending on the position of the wheel. A drawback of such a device is low heat accumulating capacity and complicated construction. Moreover, sealing of the passages of the air flows causes problems.

Air flows can be controlled along different routes by means of flow-exchange valves, but such an apparatus requires fairly high capacities of actuating devices and causes high investment costs in relation to the overall cost of the equipment. In such devices, in which air flows are guided alternatingly along different routes, the cell of the heat exchanger is, e.g., in a two-duct system, divided into two parts, cold and warm air being alternatingly passed through different parts.

The object of the present invention is to provide a control device for medium flows which is of a very simple construction and inexpensive and in which efficient sealing can be achieved easily. The control device in accordance with the invention is characterized in that the medium-flow control device consists of a cell that is divided into compartments by means of partition walls parallel to the medium flows and substantially transverse to the partition wall between the ductings and whose ends are provided with plate elements substantially transverse to the medium flows, at least one of the said plate elements being displaceable substantially in the transverse direction of the partition walls of the cell and the said plate elements being provided with alternatingly located through openings and blocking members, whose area corresponds to the area of the opening between one medium-flow duct and at least one compartment in the cell. Thus, the control device in accordance with the invention consists of a cell divided into compartments and of plate elements connected to the ends of the cell, the said elements guiding the flowing medium out of the inlet ducting into the desired compartment and from there again into the desired flow duct. In order that it should be possible to make the medium flow through different ducts, at least one of the plate elements is displaceable. It is to be noticed that this control effect is achieved by means of a simple device which requires little space and only a low-power actuating device.

According to a preferred embodiment of the invention, the cell of the control device consists of a heat exchanger, which is divided into compartments by means of partition walls, whereat the plate elements are placed at the ends of the heat exchanger. In this embodiment, the control device requires particularly little space in the longitudinal direction of the heat exchanger, because the length of the heat exchanger is increased only by the thickness of the plate elements. The plate element or elements can be displaced readily in the transverse direction of the partition walls, and they can be sealed easily in relation to the partition walls. By means of the openings and the blocking members in the plate elements, the medium flows can be guided from the medium flow duct always into the desired compartment.

According to a highly advantageous embodiment of the invention, similar displaceable plate elements are placed at both ends of the cell. Owing to this, the medium flows can always be guided straight through the heat exchanger, so that the same, e.g., cold or warm medium always flows in the outlet ducts.

Since medium is, at each particular time, admitted into the compartments in the cell through the common opening of each compartment and medium-flow duct only, it must be possible for the flow to spread in the lateral direction over the entire width of the compartment in order that the heat exchange should be as efficient as possible. The transfer of the medium in the lateral direction is promoted so that there is a free space between the plate element and the heat accumulation material present in the cell.

The control device in accordance with the invention can also be used in connection with such heat exchangers as are, in the way of ductings, divided into medium-flow ducts by means of at least one partition wall. In such a case, it is preferable that the control device is placed between the ducting and the heat exchanger and that one of the plate elements in the control device is stationary and the other one displaceable.

In their simplest embodiment, the plate elements are formed as a slide which is displaceable linearly substantially in the transverse direction of the partition walls. The slide can be sealed efficiently in relation to the partition walls in the cell so that at the edges of the openings in the slide that are placed transversely to the movement direction of the slide there is an edge rib penetrating into the cell, sealing the slide relative the partition walls.

The invention can also be accomplished so that the slide consists of component slides placed at each medium flow duct and being capable of moving in relation to the other component slides. This construction provides the advantage that the component slides can be made shorter than if a slide common for all the medium flow ducts is used. Owing to their shorter length, the component slides fit within the outer faces of the heat exchanger in all of their positions.

As an alternative for a slide, the plate element may be made of gates pivotably journalled to the end edge, e.g., of every second partition wall. This embodiment provides the advantage that it does not cause problems of sealing, because the gates are pressed tightly against the end edges of the partition walls by the effect of the medium flows.

Figure 3:
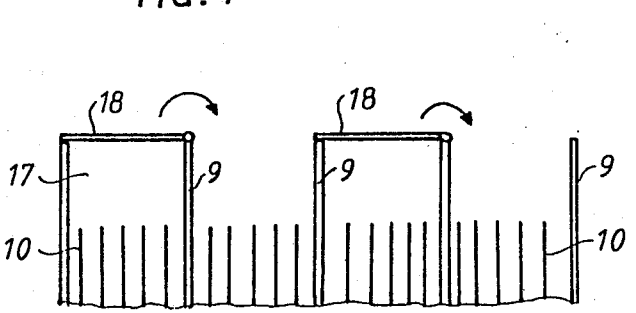
Figure 2:
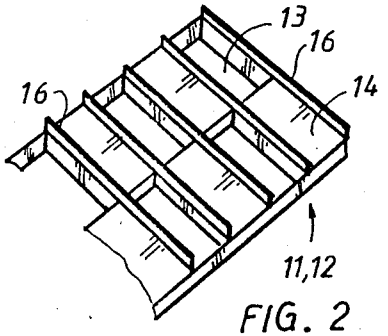
Figure 4:
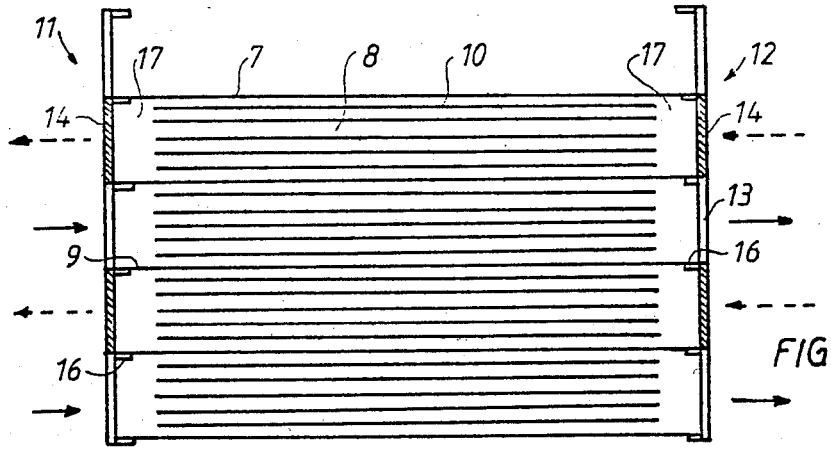
Figure 5:
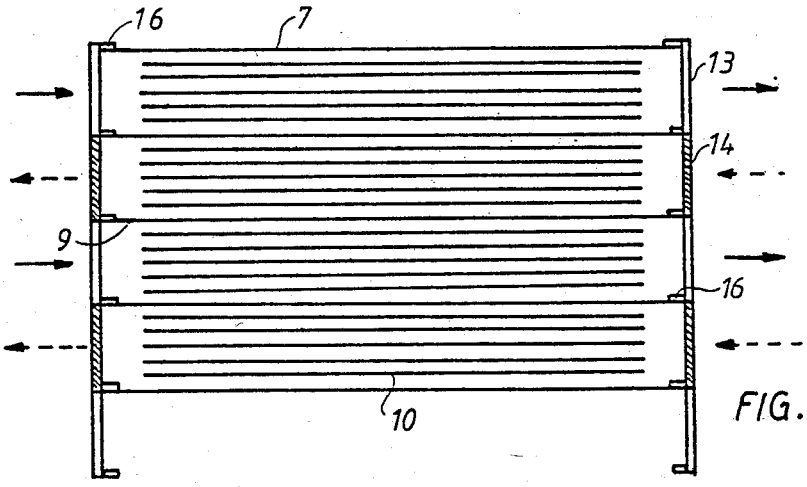
Figure 6:
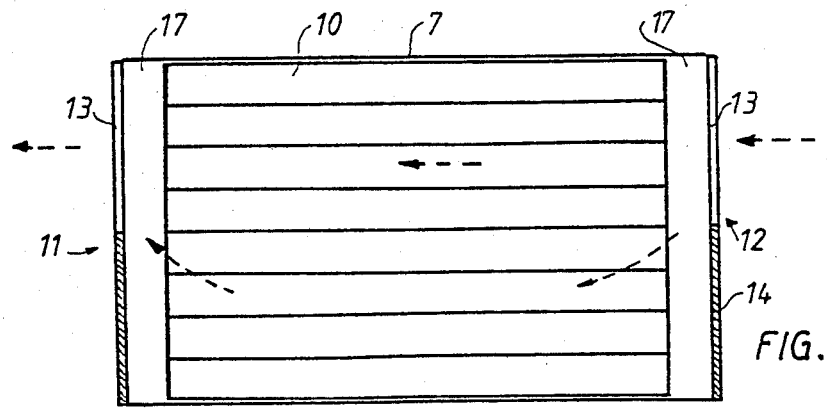
Figure 7:
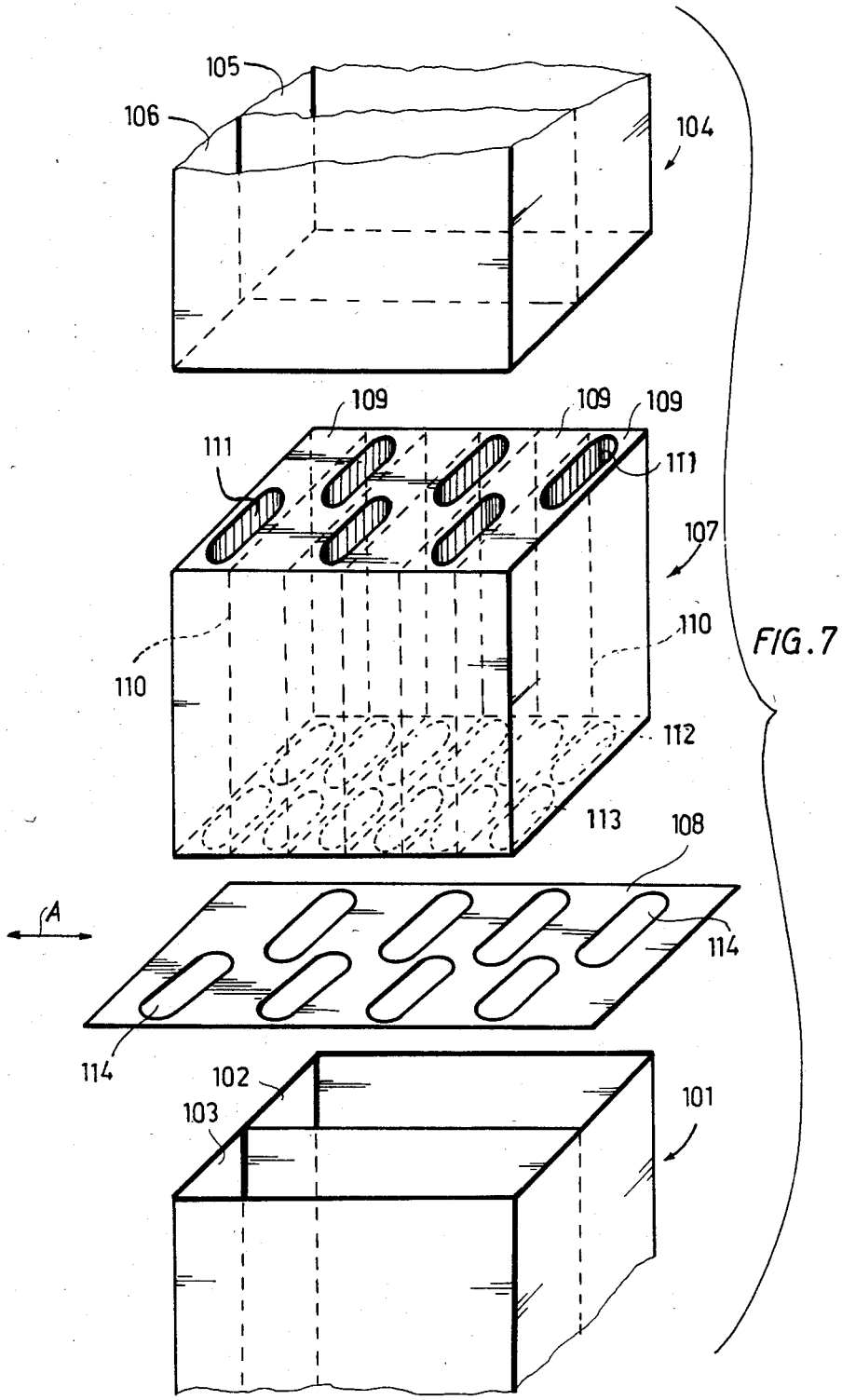
Figure 8:
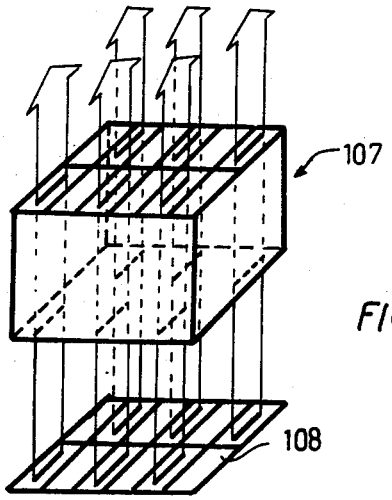
Figure 9:
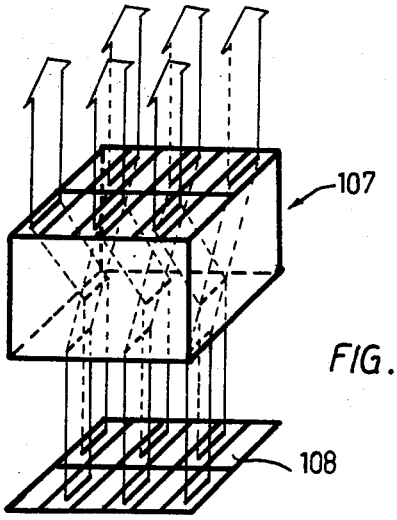

The control device in accordance with the invention will be described in more detail below with reference to the attached drawings, wherein FIG. 1 is an exploded view of a first embodiment of the control device in accordance with the invention, FIG. 2 shows a part of a slide, FIG. 3 shows a second embodiment of a plate element, FIGS. 4 to 6 are schematical illustrations of the functioning of the control device of FIG. 1, FIG. 7 is an exploded view of a second embodiment of the control device in accordance with the invention, and FIGS. 8 and 9 are schematical illustrations of two different positions of the control device shown in FIG. 7.

FIG. 1 shows a ducting 1, which is divided into two parts by means of a vertical partition wall, one of the said parts being, e.g., the duct 2 for cold air flowing into a building and the other one being the duct 3 for warm air flowing out of the building. The medium flow in the duct 2 is denoted with a broken-line arrow, and the medium flow in the duct 3 with a continuous-line arrow. The right end of the figure shows a ducting 4, which likewise comprises a duct 5 for cold air and a duct 6 for warm air.

Between the ductings 1 and 4, a heat exchanger 7 is placed, which has the same square or rectangular section as the ductings 1, 4 have. The heat exchanger is divided into several compartments 8 by means of horizontal partition walls 9, so that the heat exchanger operates as the cell for the control device. Thus, the partition walls 9 are placed transversely in relation to the partition walls in the ductings 1 and 4, and one half of the compartments 8 is placed at the flow ducts 2, 5 and the other half at the flow ducts 3, 6. In the compartments there are metal sheets 10, parallel to the partition walls 9 and functioning as heat accumulating material, the said metal sheets being preferably corrugated in view of increasing their area.

Between the heat exchanger 7 and the ductings 1, 4, slides 11 and 12 are journalled so that they can be displaced in the vertical direction between two positions. The slides are provided with openings 13 and blocking members 14. The vertical height of both the openings and the blocking members corresponds to the corresponding dimension of one compartment 8, whereas the horizontal width of the openings and the blocking members corresponds to the width of one flow duct 2, 3, 5, 6. The openings and the blocking members are arranged in the slide so that alongside an opening and above and underneath an opening, there is always a blocking member, as a result of which, at each particular time, only cold or warm air has access to each compartment of the cell. The actuating device of the slide is, e.g., a solenoid 15.

FIG. 2 shows a part of the side of a slide that is placed against the heat exchanger 7. From the figure, it is seen that the horizontal upper and lower edges of the openings 13 and of the blocking members 14 are provided with projecting edge ribs 16, which act as sealing members between the slide and the partition walls of the heat exchanger.

FIGS. 4 to 6 show the mode of operation of a heat exchanger in accordance with the invention, whereat FIGS. 4 and 5 show the heat exchanger as a vertical section and FIG. 6 shows the heat exchanger as a horizontal section. In FIGS. 4 and 5, for the sake of clarity, only four compartments 8 of the heat exchanger or cell are shown. These figures also show the free spaces 17 between the slides 11, 12 and the heat accumulator sheets 10. The arrows shown by means of broken lines illustrate the flow of cold air underneath the plane of the drawing in the ducts 2, 5, and the arrows drawn in full lines illustrate the warm flow of air placed in the plane of the drawing in ducts 3, 6.

In FIG. 4, the slides 11, 12 are in their upper positions, whereat the blocking members 14 close the connection between the upper compartment 8 and the ducts 3, 6, the connection between the second compartment from the top and the ducts 2, 5, the connection between the third compartment from the top and the ducts 3, 6, and the connection between the fourth compartment from the top and the ducts 2, 5. On the other hand, the openings 13 permit the flow of the cold air arriving out of the duct 5 through the upper compartment and the third compartment from the top into the duct 2, and the flow of the warm air through the second and the fourth compartment from the top from duct 3 into duct 6. In FIG. 6, it is shown, as viewed from the top, how the cold air flows through the opening 13 into the upper compartment 8, in which it, partly owing to the free space 17, spreads over the entire width of the compartment and then flows further through the opening 13 of the slide 11 into the duct 2. When the cold air flows through the compartment, the heat accumulator sheets 10 placed therein are cooled, whereas the sheets are heated in the compartments through which the warm air flows.

When the cold air is no longer heated sufficiently in the heat exchanger, the slides are shifted into their lower positions shown in FIG. 5, whereat warm air from channel 3 starts flowing into the uppermost compartment and the third compartment from the top, and starts heating the heat accumulator sheets 10 therein, and cold air starts flowing into the second and fourth compartments from the top, absorbing heat from the heat accumulator sheets that had just become warm. From FIGS. 4 and 5 it is seen how the edge ribs 16 are pressed tightly against the partition walls 9 of the cell.

As is seen from the above, the use of two slides makes it possible that warm air always flows in the ducts 3 and 6, and cold air always flows in the ducts 5 and 2, which simplifies the construction of the ventilation equipment.

FIG. 3 shows an embodiment of the invention in which the slide has been substituted by gates 18 pivotably journalled to the end edge of every second partition wall 9 of the cell, whereat either one of the adjoining compartments 8 can be closed by pivoting the said gates 18.

Diverging from the above, one of the slides may be substituted by a stationary plate element constructed at the end of the cell and provided with openings and blocking members. This, however, involves the drawback that, in one of the positions of the slide, the flows of air pass crosswise in the cell 7, so that, e.g. in the ducts 5, 6, in such a case, cold and warm air flow alternatingly.

FIG. 7 shows a ducting 101 which comprises two separate flow ducts 102 and 103, as well as a ducting 104, which likewise comprises two separate flow ducts 105 and 106. The ducting 104 constitutes the heat exchanger, and the flow ducts 105, 106 include longitudinal metal sheets, not shown, which act as heat accumulators.

Between the ducting 101 and the heat exchanger 104, the cell 107 and the slide 108 are placed. The cell consists of a box which has substantially the same dimensions as the heat exchanger 104 and the ducting 101 have and whose interior space is divided into several compartments 109 by means of partition walls 110 parallel to the flows. In the embodiment shown, the number of the compartments is six.

The end of the cell facing the heat exchanger is provided with one opening 111 in front of each compartment 109. The openings are located so that the opening of every second compartment is placed in front of the flow ducts 102, 105, and the opening of every second compartment in front of the flow ducts 103, 106. At the opposite end of the cell, each compartment is provided with two openings, of which the opening 112 is placed in front of the flow duct 102 and the opening 113 in front of the flow duct 103.

Between the last-mentioned end of the cell and the ducting 101, a plate-shaped slide 108 is fitted tightly, the said slide being provided with through openings 114 and the said slide being displaceable by means of an actuating device, not shown, back and forth in the direction of the arrow A. These openings are placed in two lines at the flow ducts 102, 103 so that the distance between two openings 114 corresponds to the width of one compartment 109. By the effect of the slide, each compartment is opened into the ducting 101 through one opening 112, 113 only, so that every second compartment opens itself into the flow duct 102 and every second into the flow duct 103.

The control device in accordance with FIGS. 7 to 9 operates as follows. When the slide 108 is in its right-side extreme position, air can flow out of the flow duct 102 through the openings 114, through every second opening 112, and through the openings 111 into the flow duct 105 and, in a corresponding way, out of the flow duct 103 into the flow duct 106. Thereat the air flows pass straight through the cell 107, see FIG. 8.

After the warm air flow has heated the heat accumulator sheets placed in the heat exchanger 104 to a sufficient extent, the slide is shifted by the width of one compartment 109 to the left, whereat a connection is opened from the flow duct 102 through the cell into the flow duct 106, and a connection is opened from the flow duct 103 into the duct 105, see FIG. 9. Thereat, the heat stored in the heat accumulator sheets is transferred into the cold air, at the same time as the warm air heats the sheets placed in the other flow duct of the heat exchanger.

The invention can also be used in the case that the number of air ducts is higher than two. In such a case, the slide must be divided into a number of parts corresponding to the number of air ducts. As comes out from FIGS. 1, 4 and 5, the slide must be made somewhat higher than the heat exchanger 7. The slide can be made shorter by dividing it into two component slides along the vertical middle line, which component slides can be displaced independently from each other. The slide may alternatively be a revolving disc, in which case the compartments are wedge-shaped. The revolving disk slide is useful when the ducts and the heat exchanger (cell) are cylindrical. The compartments of the cell are wedge- (or pie) shaped sections of the cylindrical heat exchanger (cell).

We claim:

1. Control device for medium flows for a regenerative heat exchanger, which is located between ductings (101, 104) divided into medium flow ducts (102, 103, 105, 106) by means of at least one partition wall and which is, in the way of the ductings (101), divided into medium flow ducts (105, 106) by means of at least one partition wall, whereby the medium-flow control device consists of a cell (107) that is divided into compartments (109) by means of partition walls (110) parallel to the medium flows and substantially transverse to the partition wall between the ducts and whose ends are provided with plate elements (108) substantially transverse to the medium flows, at least one of the said plate elements being displaceable substantially in the transverse direction of the partition walls (110) of the cell and the said plate elements being provided with alternatingly located through openings (111, 114) and blocking members, whose area corresponds to the area of the opening between one medium-flow duct (102, 103, 105, 106) and at least one compartment (109) in the cell, characterized in that the control device is located between the ducting (101) and the heat exchanger (104) and that one of the plate elements of the control device is stationary and the other one (108) displaceable.

2. Control device as claimed in claim 1, characterized in that the displaceable plate element consists of a revolving disc.

3. Heat exchanger as claimed in claim 1, characterized in that at the edges of the openings of the slide (11, 12) that are directed perpendicularly to the direction of movement of the slide there is an edge rib (16) penetrating into the cell (7) and sealing the slide in relation to the partition walls (9).

* * * * *